United States Patent [19]

Zapp

[11] 3,986,627

[45] Oct. 19, 1976

[54] CLOSURE

[75] Inventor: Walter Zapp, Oberegg, Switzerland

[73] Assignee: REFIL Aktiengesellschaft

[22] Filed: Dec. 15, 1975

[21] Appl. No.: 641,076

Related U.S. Application Data

[63] Continuation-in-part of Ser. No. 533,490, Dec. 17, 1974.

[30] Foreign Application Priority Data

Oct. 31, 1975 Switzerland ..... 14086/75

[52] U.S. Cl. ..... 215/237; 215/272; 215/305; 215/306; 215/320; 215/344

[51] Int. Cl.[2] ..... B65D 45/34

[58] Field of Search ..... 215/272, 320, 321, 235, 215/236, 237, 244, 245, 256, 305, 306, 100.5, 344

[56] References Cited

UNITED STATES PATENTS

| | | | |
|---|---|---|---|
| 2,814,404 | 11/1957 | Towns | 215/320 |
| 2,894,654 | 7/1959 | Lohrer | 215/235 |
| 2,990,077 | 6/1961 | Van Baarn | 215/256 |
| 3,851,783 | 12/1974 | Braginetz | 215/245 |

*Primary Examiner*—Ro E. Hart
*Attorney, Agent, or Firm*—Heinrich W. Herzfeld; Gilbert L. Wells

[57] ABSTRACT

This invention relates to a closure which serves hermetically to close - though being easily reopened - a bottle or similar container, which possesses a neck having a dispensing orifice, a neck frontal face surrounding said orifice and an orifice bead located below the latter and having a constriction on its underside, and which closure comprises a cap serving as the head of the closure, with an upper cap wall (or roof wall of the cap) and a cap side wall circumferential about the latter and possessing slot means, extending from its lower rim and transversely to the latter, to permit it to splay (or spread) on being mounted on the mouth of the bottle, and with an inner annular head, projecting inwards from the inner face of the cap side wall and intended, in the closing position, to engage with the underside of the orifice head of the bottle, a sealing element, provided on the inner face of the upper cap wall and serving, in the closing position, to seal the dispensing orifice of the bottle, a lifting element which may be actuated by the finger and is located on the actuating side of the cap, and a fixing device which, in the closing position, annularly bridges each slot present in the cap side wall, by sealingly pressing the inner annular bead of the cap side wall against the constricted underside of the orifice bead of the bottle, and which is linked to the cap side wall in at least one region, remote from the actuating side of the cap side wall; the fixing device comprises at least one tensioning member which, in the closing position, is tensioned by being stretched radially to the cap side wall and as a result effects a compression of each slot present in the side wall and provides a uniform pressure, from all sides, of the inner annular bead of the cap against the underside of the bottle neck.

17 Claims, 14 Drawing Figures

CLOSURE

RELATION TO EARLIER APPLICATION

This application is a continuation-in-part of my pending patent application Ser. No. 533,490 filed Dec. 17, 1974.

This invention relates to a closure which serves hermetically to close — through being easily reopened — a bottle or similar container, which possesses a neck having a dispensing orifice, a neck frontal face surrounding said orifice and an orifice bead located below the latter and having a constriction on its underside, and which closure comprises a cap serving as the head of the closure, with an upper cap wall (or roof wall of the cap) and a cap side wall circumferential about the latter and possessing slot means, extending from its lower rim and transversely to the latter, to permit it to splay (or spread) on being mounted on the mouth of the bottle, and with an inner annular bead, projecting inwards from the inner face of the cap side wall and intended, in the closing position, to engage with the underside of the orifice bead of the bottle, a sealing element, provided on the inner face of the upper cap wall and serving, in the closing position, to seal the dispensing orifice of the bottle, a lifting element which may be actuated by the finger and is located on the actuating side of the cap, and a fixing device which, in the closing position, annularly bridges each slot present in the cap side wall, by sealingly pressing the inner annular bead of the cap side wall against the constricted underside of the orifice bead of the bottle, and which is linked to the cap side wall in at least one region, remote from the actuating side, of the cap side wall.

A closure of this type is already known from U.S. Pat. No. 2,671,572 to William Satz, granted on Mar. 9, 1954. The bottle closures described in German Offenlegungsschriften 2,210,414 to Albert Obrist & Co. and 2,319,617 to Jean Grussen provide ring members which are connected in a manner which permits swivelling to a cap and are connected to the periphery of the cap by small tear-off stays prior to the first opening of the bottle, with the undamaged stays merely indicating that the cap has never yet been removed from the filled bottle. After tearing the stays, the ring member serves as a gripping ring for the first opening of the bottle, and for removing the cap whenever subsequently the bottle is opened. However, neither of the two last-mentioned ring members contributes to a better fixing of the cap onto the bottle mouth to resist internal pressure in the bottle. The bottle closure described in U.S. Pat. No. 3,825,144 by Walter Wiedmer is either blown off the bottle if the pressure therein rises, even by a relatively small amount, or is too stiff and therefore is seated to firmly to permit easy opening of the bottle with one finger of one hand.

In contrast to these ring members, the ring member provided in the closure of William Satz, and described above, plays an essential role in sealing the closing of the bottle, but this ring member suffers from certain disadvantages. In order that it shall sufficiently sealingly press the slotted cap side wall against the orifice bead of the bottle, the ring must not be excessively elastic. Furthermore, on the lifting side there is, over a zone corresponding to an approximately 40° arc of a circle, no contact between the ring member and the cap side wall. In order that the cap side wall should evenly press against the bottle over the remaining circumference of about 320°, the ring member must be relatively rigid and therefore its action on the cap side wall is more to hold it together than to compress it, that is to say the lower end regions of the tabs are passively prevented from being splayed off the underside of the orifice bead of the bottle if the pressure inside the bottle should rise, eg. as a result of a rise in temperature or of shaking the contents, but are not actively pressed against the underside of the orifice bead. If the latter is to be achieved, the pressure of the ring member on the cap side wall must be so great that lifting the ring member in order to open the bottle becomes much more difficult.

However, it is a well-known problem of such bottle closures that on the one hand they are to achieve the most effective seal of the dispensing orifice of the bottle, which seal withstands even increased internal pressures of 6 to 8 atmospheres gauge, whilst on the other hand the opening of the bottle by removing the closure should be so easy that it should not require any tools and should if possible be achievable with one finger, eg. the thumb of the hand which holds the bottle by the neck.

It is therefore a principal object of the invention to provide a closure of the type described initially in which the ring member actively and sufficiently seals the bottle whilst acting on the cap side wall on all sides of the bottle neck and nevertheless permits the removal of the ring member and lifting of the cap with relatively little exertion of force, eg. with the thumb of the hand which holds the bottle by the neck.

It is a further object of the present invention that the sealing of the dispensing orifice of the bottle in the closing position, which in the closure described initially is to be effected by a sealing disc of flexible material inserted into the inside of the cap, should be adaptable to the unevennesses which are usually found, above all in bottles made of glass, both on the frontal face and on the inner wall of the part surrounding the dispensing orifice, in the form of variations of up to 1 mm in height or width, and to ensure a seal regardless of these unevennesses.

These objects and purposes are attained and further advantages described below are achieved by a closure of the initially described type which, in accordance with the present invention, is improved in that the fixing device comprises at least one tensioning member which, in the closing position, is tensioned by being stretched tangentially to the cap side wall and as a result effects a compression of each slot present in the side wall and provides a uniform pressure, from all sides, of the inner annular bead of the cap against the underside of the orifice bead of the bottle neck.

The fixing device may in particular comprise a ring member which before closing is bent upwards somewhat, on the actuating side, away from its closing position, and on closing is moved downwards, by its region on the actuating side, whereby the slotted cap side wall is compressed and at the same time is sealingly pressed, by its inner annular bead, against the underside of the orifice bead of the bottle, whilst the tensioning member provided on the actuating side of the ring member, between the latter and the outer face of the cap side wall, is a tensioning device which is tensioned in the closing position whilst the tension can be released by lifting the ring member, which tensioning device achieves the compression of the cap side wall in the closing position by pulling this wall against the orifice bead of the bottle neck on a hinge side located opposite the actuating side, and by pressing this wall against the orifice bead of the bottle neck on the actuating side, as well as a tangential stretching of the ring member from the hinge side towards the actuating side and, as a result, a uniform pressing of the cap side wall against the orifice bead of the bottle neck even in the regions between the hinge side and the actuating side. Thereby, the ring member can at the same time be in the form of a securing ring which is connected to the cap side wall, on the side opposite the actuating side, by a bridging member.

The tensioning device may comprise at least one stiff or rigid tensioning member, connected in the form of a toggle (lever) to the securing ring, which tensioning member is supported on the cap side wall and, in the closing position, tensions the securing ring by being turned, in the direction of the plane of the peripheral rim of the cap, so as to stretch the toggle. In particular, the tensioning device may comprise, as tensioning members, at least one, and preferably two, rigid stays which limit the swivelling movement of the securing ring relative to the cap and which are articulatedly connected, on the actuating side, both to the ring and to the cap.

The securing ring can carry, on the actuating side, a clamp member, serving as a manually movable handle part and possessing a nose pointing inwards to the bottle neck wall, which member engages, in the closing position, in a notch on the lower rim of the closure.

The lower peripheral rim of the cap can in that case be provided with several axial slots which permit splaying (or spreading) of the cap side wall when the cap is pushed over the mouth of the bottle neck when the securing ring is swung upwards from the lower cap rim, whilst with the cap in position and the securing ring stretched, moved downwards towards the lower cap rim and held detachably against the cap, the said securing ring compresses the slots of the peripheral rim and hence prevents further splaying of the cap side wall if the internal pressure in the bottle should rise.

Preferably, the securing ring, the cap and the bridging member which connects the cap to a securing ring may be integral with one another. Finally, in this embodiment, the fixing device may comprise a part constructed as a supporting member (or muff), which can be firmly mounted on the bottle neck below the bottle mount, on which part the cap is carried, in a manner which permits swivelling, on the side of the bridging member. In order conjointly to carry the securing ring and the cap, in a manner which permits swivelling, the supporting member may be provided with s strap joint which is integral with the supporting member and the securing ring.

Alternatively, the stiff or rigid tensioning member may be a nose projecting from the inner wall of the securing ring on the actuating side and the cap side wall may possess, on the actuating side and towards its lower peripheral rim, a recess into which the nose snaps in the closing position, with tangential tension of the lateral regions of the cap side wall.

A particularly good sealing effect, with good removability of the closure, is achieved if, in the preferred embodiment described above, the closure device, constructed as a cap, bears on the inner wall of its upper face, as a sealing element, a stopper whereof, in the closing position, the lower end projects into the bottle mouth, whilst its cylindrical outer wall is chamfered towards the lower end.

At the same time, it is particularly advantageous that the annular space in the interior of the closure device around the stopper is constantly in communication with the external air via the upper end of the slot.

As an additional sealing element, it is possible to provide, around the stopper, a sealing collar which projects inwards from the upper inner wall of the closure device and which is elastically deformed in the closing position so that it rests sealingly on the frontal face of the bottle mouth.

In the preferred embodiment of the closure according to the invention, the sealing collar may be of circular cross-section at its foot, which adjoins the inner wall of the cap, and be of elliptical crosssection at the free rim of the collar when the cap is in the open position, with the major axis of the ellipse extending from the bridging member to the opposite side wall of the cap and with the distance of the free rim of the collar from the foot of the collar being constant.

According to another embodiment, the sealing collar may have a circular cross-section at its foot which adjoins the cap inner wall and at the free rim of the collar, and axial cut-out emanating from the free rim of the collar can be provided so that the segments, left between the cut-outs, of the collar wall which adjoins the free rim of the collar are pushed together in the closing position and sealingly rest against the frontal face of the bottle mouth.

Finally, in a third preferred embodiment, the sealing collar can comprise a stiffened sealing ring and the collar wall which connects the said ring to the foot of the collar can have a slightly deflectable foot wall zone, adjoining the foot, a more flexible and more elastic bending zone which adjoins the foot wall zone, and a more rigid neck zone, carrying the ring, the ring being thickened so that when it rests against the frontal face of the bottle mouth a free space remains between this frontal face and the collar wall, which space, in the first-described embodiment of the closure, is in communication with the external air through axial slots in the side wall of the cap.

Further particulars of the invention will be seen from the following description of preferred embodiments thereof in conjunction with accompanying drawings, wherein FIG. 1 shows a cross-sectional view through a first embodiment of the bottle closure according to the invention, mounted on the mouth-portion of a bottle and in the open position;

Figure 1:
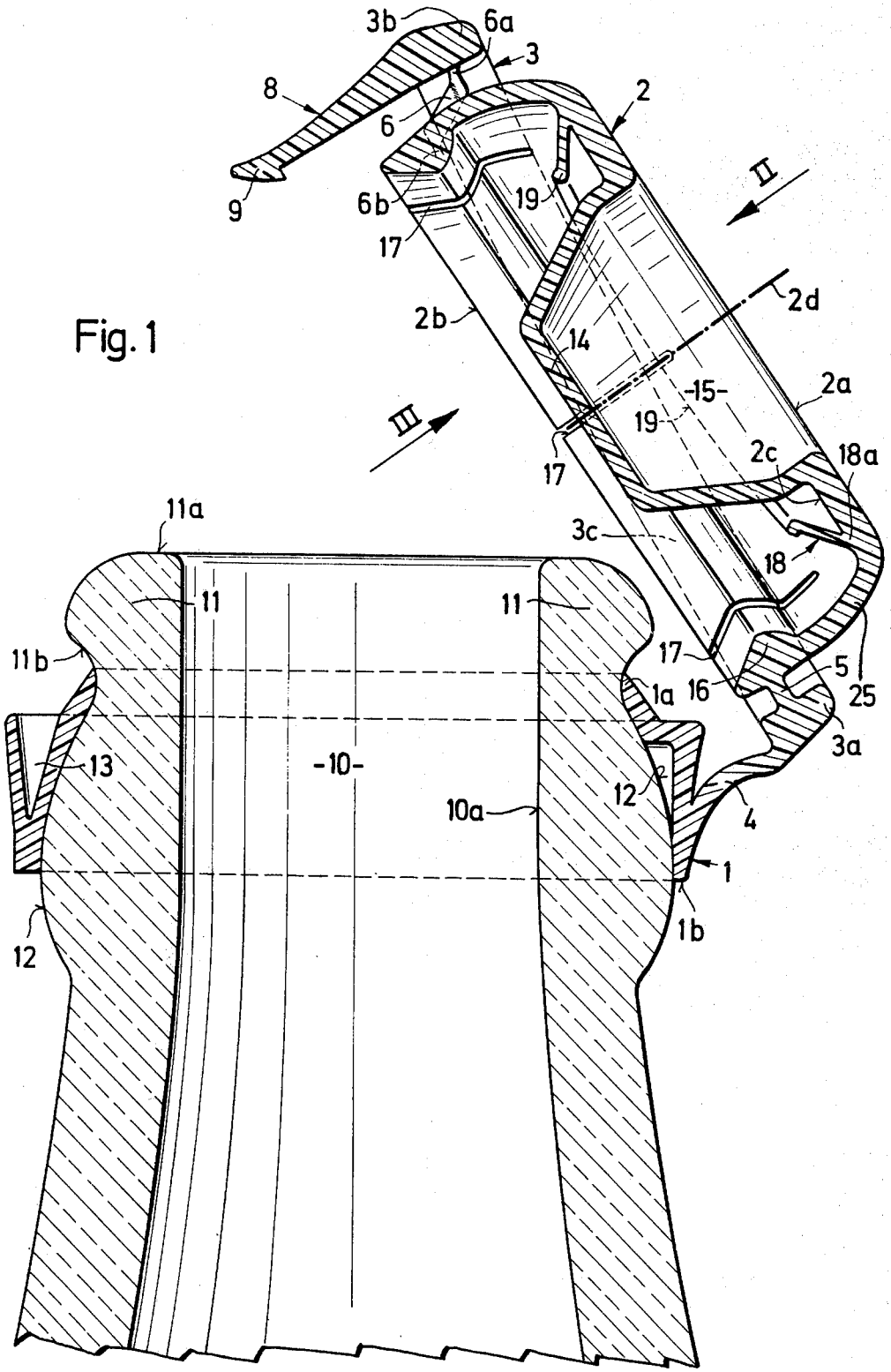

The first embodiment of the bottle closure according to the invention which is shown in FIGS. 1 – 9 consists of three main parts, namely a supporting member 1, a cap 2 and a securing ring 3, which are united into a single piece by means of flexible elastic joining members. The supporting member 1 is connected to the securing ring 3, in a manner which permits swivelling, by means of an elastically flexible hingelike strap-joint 4 and the ring 3 is in turn connected to the cap 2, in a manner which permits swivelling, by means of a somewhat flexible bridging member 5. Whilst the strap-joint 4 allows the ring 3 to be turned back, together with the cap 2, from the supporting member 1, through an angle of up to about 180° and even further, the swivelling of the cap 2 relative to the ring 3 by means of the bridging member 5 is limited by the length of two stays 6 and 7, which are articulatedly but inseparably connected, on the one hand, with the ring 3 by means of elastically flexible stay ends 6*a* and 7*a*, which are preferably less thick than the middle portion of the stay, and on the other hand with the cap 2 by means of correspondingly formed stay ends 6*b* and 7*b*.

The supporting member 1 is pushed, with elastic stretching, onto the mouth-portion of a bottle neck so that it comes to rest with its upper rim 1*a* below the orifice bead 11 which surrounds the mouth 10 of the bottle and is supported on the adjacent neck wall 12, which widens away from the bottle mouth 10. At the same time the fact that, when the supporting member is not mounted on the bottle, the diameter of the central opening of the supporting member 1 at the upper end thereof, facing towards the bottle mouth 10, is smaller than the external diameter of the orifice bead 11 of the bottle neck and also smaller than the inner diameter of the supporting member 1 at its opposite end 1*b*, i.e., the end away from the bottle mouth 10, contributes to securing the supporting member on the bottle neck. On the side of the supporting member 1 opposite to that to which the strap-joint 4 is connected, the supporting member 1 is provided with a trough-shaped recess 13 which is open towards the upper end of the supporting member and serves as a drip-catcher.

Figure 2:
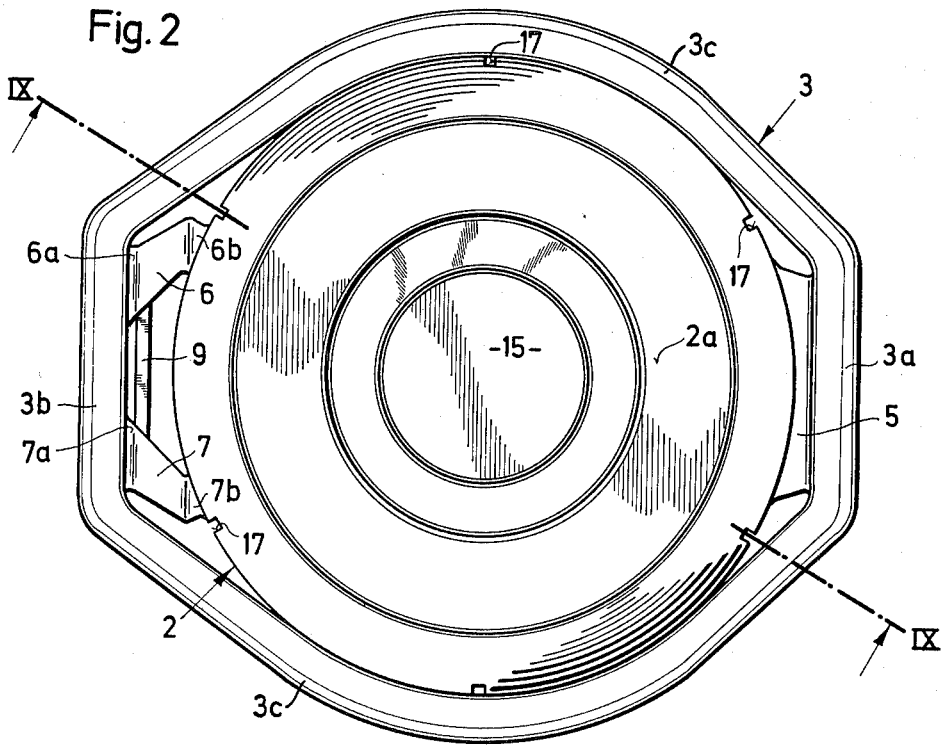
FIG. 2 shows a top view of the cap-portion of the closure of FIG. 1.
Figure 3:
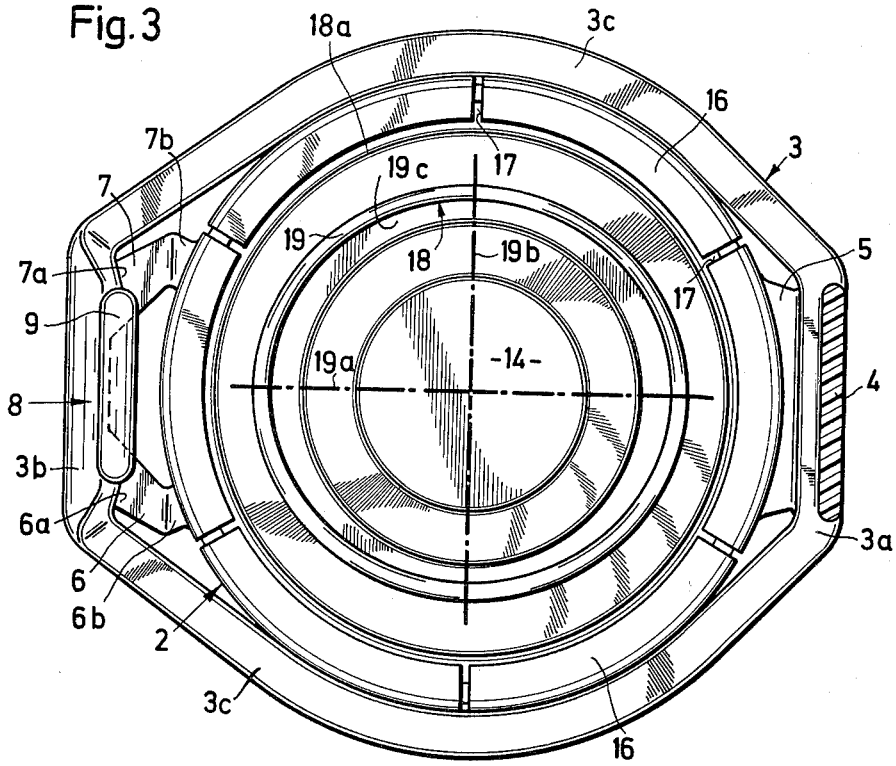
FIG. 3 is an internal view of the inside of the cap-portion of FIG. 2.
Figure 6:
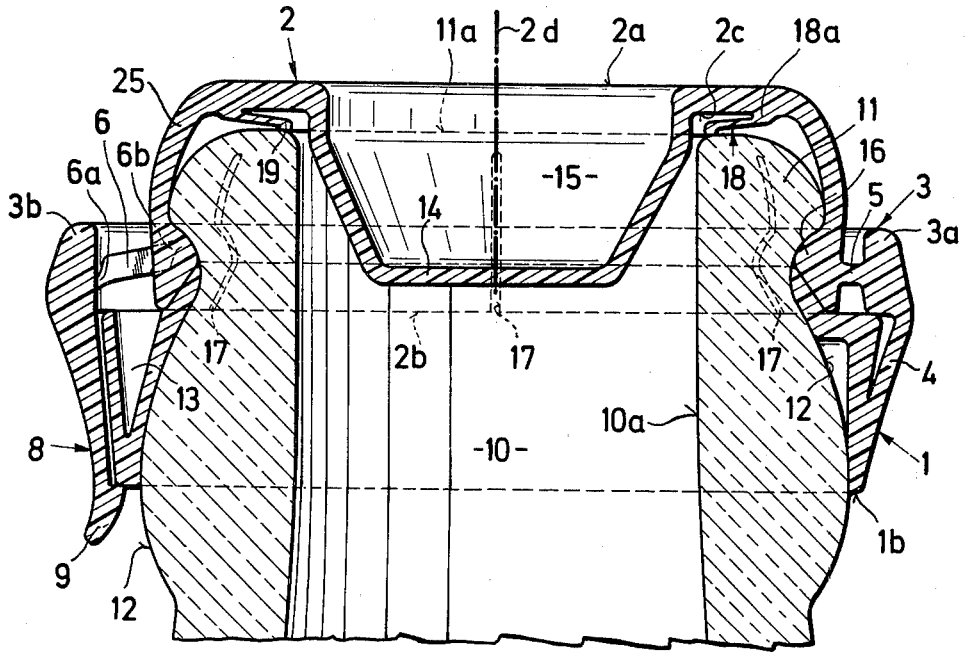
FIG. 6 shows a corresponding view in cross-section in the fully closed position.

As can be seen from FIGS. 2 and 3, the securing ring 3, which by means of the strap-joint 4 forms a single piece with the supporting member 1, has a shape deviating somewhat from a circle in that it extends outwards in the region where it is joined to the strap-joint 4 as well as at the region on the opposite side of the ring. On the one hand bending of the ring 3 and the cap 2 connected therewith from the supporting member 1, is thereby facilitated, and, on the other hand, it is made possible to mount the abovementioned means limiting the relative angular displacement of ring 3 relative to cap 2, namely the bonding stays 6 and 7. In the embodiment shown in the drawings, the extensions 3*a* and 3*b* of securing ring 3 complete the form of a trapezoid. Naturally, they can also be elliptical, oval, or of any other desired shape, as long as each end region is at a greater distance from the centre of the basic circular form than the intermediate regions 3*c* of ring 3. However, the intermediate regions 3*a* of the securing ring 3 lying between the two end regions 3*a* and 3*b* should in any case extend over as large as possible an arc in contact with the side wall of cap 2. At its end region 3*b* remote from strap-joint 4, securing ring 3 carries a downwardly directed clasp member or tongue-hook 8, which carries a nose 9 on the internal wall of its free end facing the bottle wall, by means of which it can hook in the latching position under the lower edge 1*b* of the supporting member 1 (FIG. 6).

Figure 4:
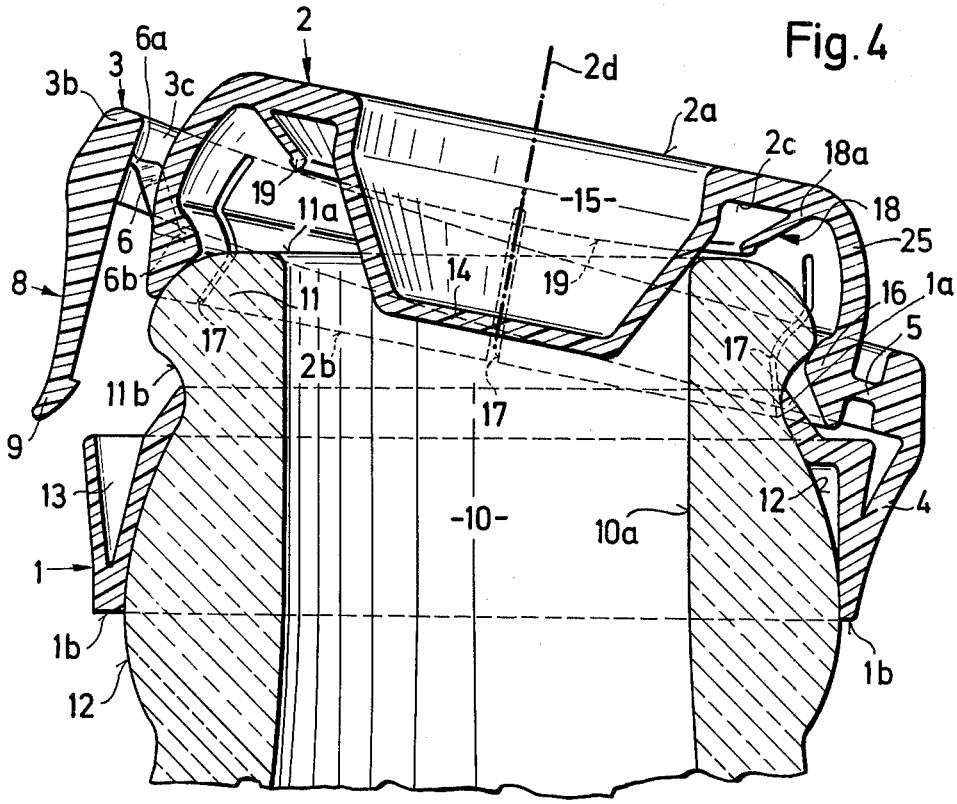
FIG. 4 and 5 show views corresponding to FIG. 1 with the cap-portion in two different stages during the closing movement.
Figure 5:
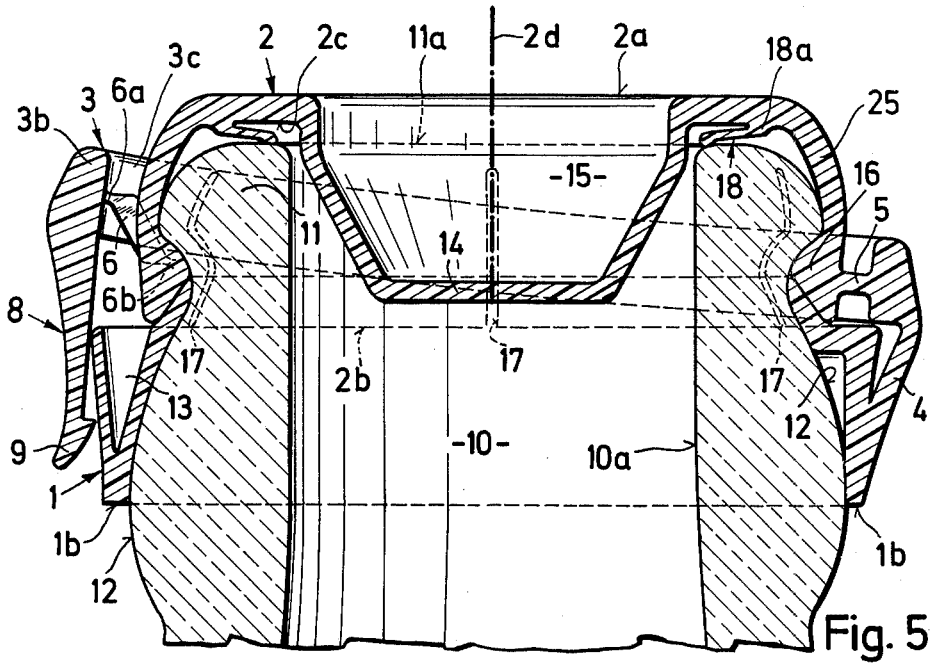

At the end region 3*a* of the securing ring 3, the bridging member 5 is attached to the inner side of the ring 3, being preferably integral therewith, and carries the cap 2, which in turn is preferably integral with the bridging member 5 in such a manner that the ring 3 extends around the cap 2 and is bent upwards so that its end region 3*b* is displaced from the lower cap rim 2*b* towards the upper side 2*a* of the cap, when the ring is untensioned (FIGS. 1, 4 and 5). In this untensioned position, the stays 6 and 7 are so inclined that their ends 6*a* and 7*a*, which are articulatedly connected with the ring 3, are situated above the stay ends 6*b* 7*b* respectively, which are articulatedly connected with the cap 2, i.e., the stays 6 and 7 are preferably disposed at an angle of 60 – 75° relative to the plane of the ring 3. The cap 2 possesses on its inner face a centrally disposed stopper part 14 which extends with clearance into the bottle mouth 10 to centre the cap 2. To save material and to avoid development of tensions in the injection-molded material, the stopper part 14 preferably has a recess 15 open towards the upper face 2*a* of the cap. Towards its lower rim 2*b*, the cap 2 has an annular bead 16 on its inner lateral wall, and is provided with axial slots or cuts 17 extending from the lower rim 2*b* of the cap almost up to the upper side 2*a* of the cap 2 so that its lower rim portion is rendered more elastically extensible.

On the inside face 2*c* of the upper cap wall 2*a*, the cap 2 carries a sealing collar 18 which is preferably formed integral with the cap 2. In a first embodiment, the foot-end 18*a* of the collar 18, which is joined to the inside wall 2*c*, has a circular cross-section when untensioned (FIG. 3), whereas the free rim 19 of the collar, which is directed towards the bottle neck end, is of elliptic configuration when untensioned. The major axis 19*a* of this ellipse extends from the middle of the bridging member 5 to the mid-point between the stays 6 and 7. As a result of the circular shape of the foot end 18*a* of the collar 18, the wall of the collar in the region of the two ends of the major axis 19*a* of the ellipse, when untensioned, is less steeply inclined relative to the longitudinal axis 2*d* of cap 2 than the wall of the collar in the region of the minor axis 19*b* of the ellipse (FIGS. 1 and 3).

Figure 7:
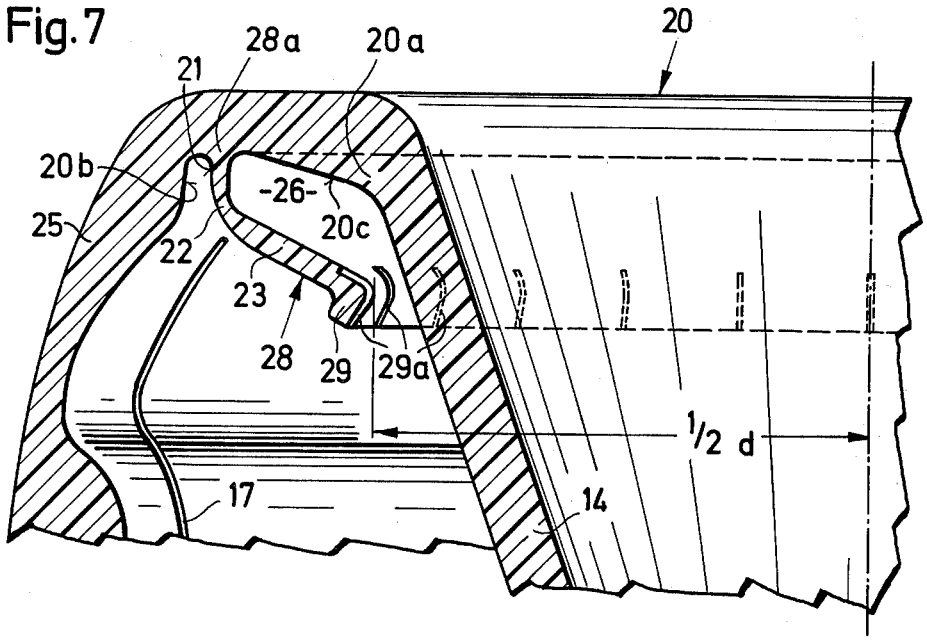
FIG. 7 shows a sectional view through a part of the cap in the open position, with a preferred embodiment of the sealing collar.
Figure 8:
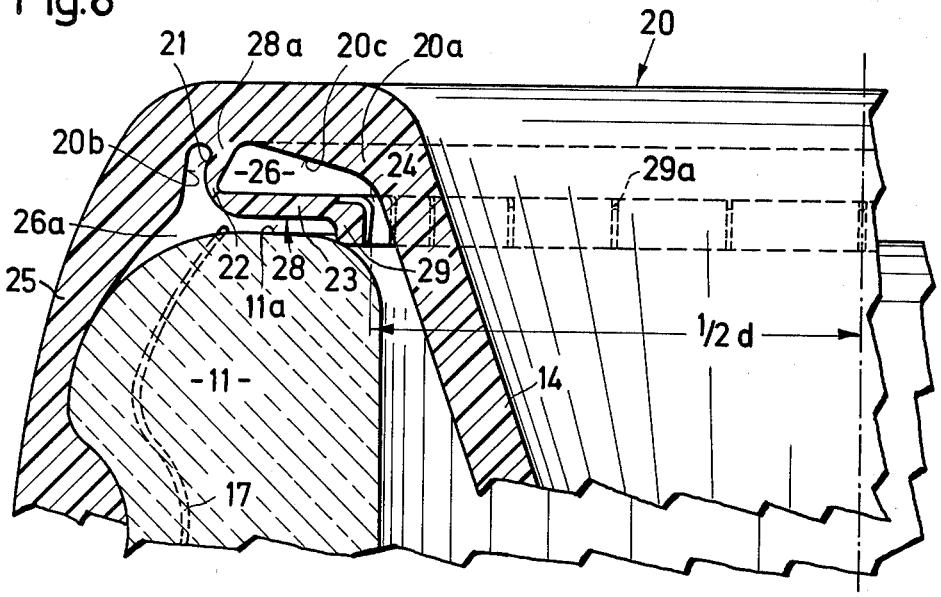
FIG. 8 shows the same section as in FIG. 7, but with the cap in the closing position.

Another preferred embodiment of a sealing element is shown in FIGS. 7 and 8. Herein, the sealing collar 28 comprises a sealing ring 29 which is stiffened by a correspondingly greater thickness of the wall, whereas the collar wall connecting the ring 29 with the foot end 28*a* of the collar comprises a somewhat deflectable foot wall region 21 adjacent to the foot end 28*a*. This wall region 21 merges into an adjacent bending region 22 which, owing to its correspondingly thinner wall, is more flexible and elastic, and to which there then is joined a neck region 23 which carries the ring 29 and is stiffer, owing to its greater wall thickness. The functioning of this sealing element shown in the closing position of FIG. 8 will be further explained below.

The differences in the thickness of the wall regions 21, 22 and 23 are dependent upon the extensibility of the material of which the cap and sealing collar are made. When the material is sufficiently extensible to allow circumferential expansion in the bending region 22 without appreciable elliptical deformation, the wall thickness of all three regions can be the same.

The bottle closure according to the invention, which is shown in FIG. 1 in the open position, is closed by hand by means of pressure of a finger on the upper side 2*a* of the cap, whereby cap 2 and ring 3 pass at first through the position shown in FIG. 4. In this position it is the region of the free collar rim 19 being located at the end of the major axis 19a of the ellipse adjacent to the strap-joint 4 and the bridging member 5 which first comes into contact with the frontal face 11a surrounding the bottle mouth 10 at the end of the neck of the bottle, while at the same time the stopper part 14 of the cap 2 glides into the bottle mouth 10 via its rim zone facing the strap-joint 4 accompanied by simultaneous pressure of the inner annular bead 16 of the cap on the lower side 11b of the orifice bead 11 of the bottle in its region facing the strap-joint 4. At the same time, the region of the inner annular bead 16 of the cap which is opposite to the last-named region comes into contact with the upper part of the orifice bead 11 of the bottle and slides downwards on that bead into the position shown in FIG. 5, wherein the inner annular bead 16 of the cap 2 engages on all sides underneath the orifice bead 11 of the bottle.

While the cap 2 is being pushed down from the position of FIG. 4 into that of FIG. 5, the free collar rim 19 of the sealing collar 18 is so deformed by pressure on the frontal face 11*a* of the bottle mouth that it takes the shape of a circle. Consequently, the collar wall in the region of the two ends of the major axis 19*a* of the ellipse inclines more steeply relative to the longitudinal axis 2*d* of the cap, and the collar wall in the region of the two ends of the minor axis 19*b* of the ellipse inclines less steeply to the longitudinal axis 2*d* of the cap, than was the case in the untensioned state of FIG. 1. Thus, when the sealing collar 18 is in the closing position of FIGS. 5 and 6, it rests sealingly upon the frontal face 11a of the bottle mouth with its collar rim 19 being then of circular configuration and the collar wall being everywhere of equal inclination to the longitudinal axis 2*d* of the cap 2.

In the closing position of the sealing collar 28 shown in FIG. 8, the stiff sealing ring 29 rests on the upper frontal face 11*a* of the bottle mouth while retaining its means diameter *d* that it assumes in the open position (FIG. 7), whereby the neck region 23 is bent inwards with regard to the stiff wall region 21 and the latter is bent outwards, at its foot end 28a, against the wall of the cap 20. In this position, a passage 24 must remain between the wall of the stopper part 14 inside the bottle and the sealing ring 29, by way of which passage the space inside the bottle remains in free communication with the smaller annular space 30 between collar 28 and the upper inner wall 20*c* of the cap. The space 26*a* remaining between the angularly deformed sealing collar 28, the inner side wall 20*b* of cap 20 and the frontal face 11*a* of the bottle mouth is in communication with the outside air via slots 27.

If the pressure increases inside the bottle, eg. when the ambient temperature rises, then the force component acting on the neck region 23 in the annular space 26 counteracts the force component that is acting on the opposite frontal wall of the cap and is trying to blow the cap off the bottle mouth, and compensates the latter; thus, the latter force component can act only on the limited surface of the stopper part 14 but not on the considerable circular surface of the upper inner wall 20c of the cap.

As the wall regions 21 and 22 of the sealing collar 28 must always have less thickness than the cap 20, it would be possible for the sealing collar to be ruptured at extremely high internal pressure. In order to prevent this, the distance between the bending region 22 and the inner side wall 20*b* of the cap 20 is so small in the closing position (FIG. 8) that, when the inner pressure rises very greatly, the bending region 22 of the sealing collar 28, which under these circumstances may be slightly stretched, lies on this inner wall 20*b*.

In order to prevent the neck region 23 from snapping through a critical region of greatest, possibly elliptical, deformation or even jogging of the collar in the direction toward the inner wall 20*c* of the cap when the sealing ring part 29 comes to rest on the frontal face 11*a*, the cap is so strengthened on its inner side in the zone 20*a* facing the sealing ring part 29 that the critical position cannot be reached, And if, under these conditions, the sealing ring part 29 should come to lie against the zone 20*a* of the inner wall 20*c* of the cap, then the free communication via radial grooves 29*a* between the free space surrounding the stopper part 14 in the bottle mouth and the inner space 26 is maintained so as to take care of the necessary passage of gas and possibly to equalise dimensional variations.

In the closure position (FIG. 6) the cap 2 extends over the bottle mouth and is held by gripping with the annular bead 16 of its side wall 25 the annular groove 11*b* present below the mouth in all standard bottles for beverages.

Figure 9:
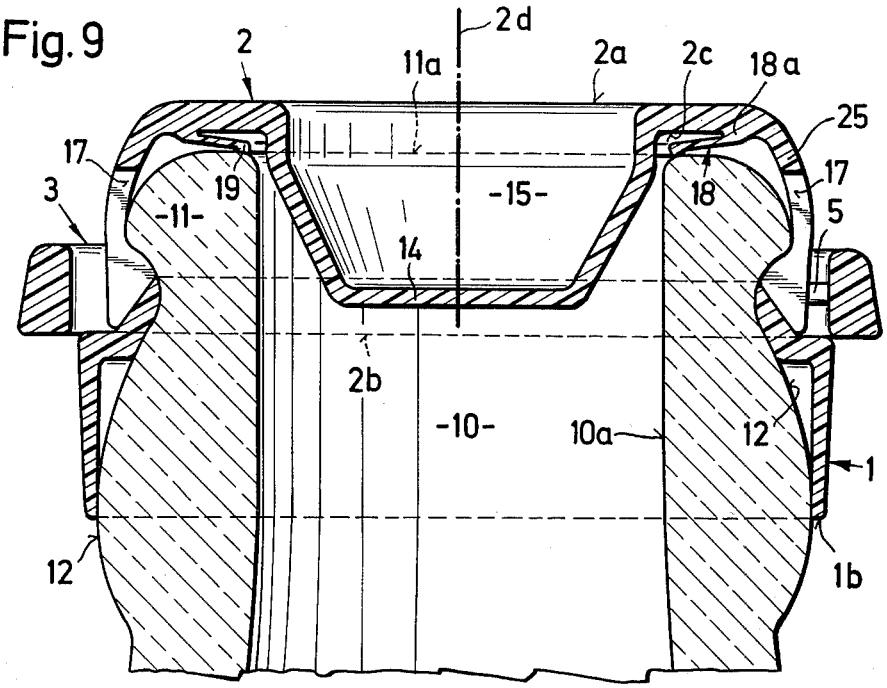
FIG. 9 shows a cross-section in the closing position, similar to that of FIG. 6, but in the plane indicated by IX—IX in FIG. 2.

The sliding of the lower rim 2*a* of the cap over the orifice bead 11 when the bottle is being opened or closed is made easier by a slight elastic splaying of the segments of the side wall 25 of the cap which are formed in the side wall by the axial slots 17 (FIG. 9). In the embodiment shown (FIGS. 2 and 3) six slots 17 are present.

Figure 10:
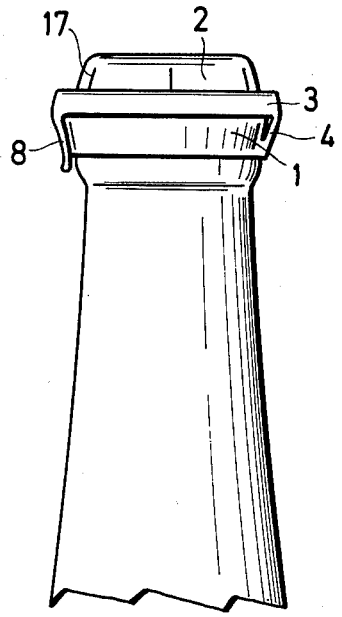
FIGS. 10 and 11 show side views of the bottle closure in the closing position, on the mouth-portion of a bottle neck.
Figure 12:
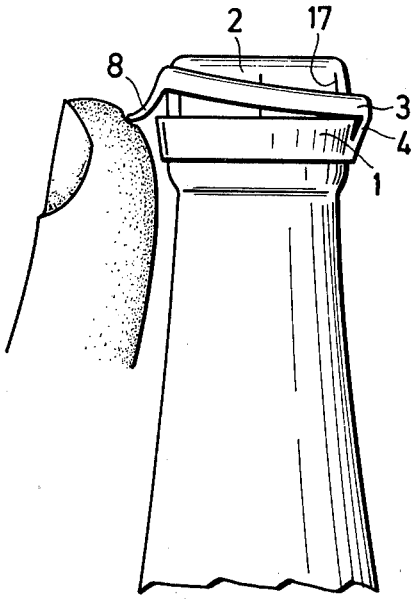
FIG. 12 shows the same view, but in an intermediate position during opening, which approximately corresponds to the position of FIG. 5 during closing.

In order to secure the cap in the closing position against lifting off from the bottle as a result of the pressure prevailing in its interior, the securing ring 3, which in FIG. 5 and FIG. 12 is still curved or bent away upwards in its region 3*b* remote from the strap-joint 4, is now bent downwards by pressure of a finger on the clasp member 8 into the securing position shown in FIGS. 6 and 10. It thereby prevents the segments of the lower rim 2*b* of the cap between the slots 17 from splaying by surrounding most of these segments close above the lower rim 2*b* of the cap and positively pressing against the segment which is connected with the stays 6 and 7 by means of the stay ends 6*b* and 7*b*, because of the tensioning swinging movement of the stays 6 and 7 into the main plane of the ring 3. As they thus assume a flat position (toggle effect), the stays 6 and 7 urge the front region 3*b* of the ring 3 outwards, and the front element of the cap, which the two stays adjoin at 6*b* and 7*b*, is correspondingly urged upwards.

Owing to the tension thus created in the ring, the side regions 3*c* of the ring 3 are pressed against the side segments of the rim of the cap 2, and consequently also via the bridging member 5 against the opposite rim segment of the cap 2, which segment is joined to the said bridge member, whereby the rim of the cap is secured all around against giving way outwards. Consequently, the cap as a whole can now also no longer give way upwards as long as the internal pressure does not exceed the elastic tension of the ring 3. Hence the highest pressure allowed corresponding to the strength of the bottle, which must not be exceeded in order to avoid dangerous explosions of the bottle, can be determined by the choice of material and cross-section of the ring 3.

To prevent the side regions 3*c* of the ring from jamming to the cap 2, before the front part 3*b* of the ring has reached its final position, it is advantageous to shape the ring 3 so that it bends slightly upwards in its untensioned state (FIG. 12); for its side regions 3*c* will then reach their lower, final position sooner than will its front edge at 3*b*, before the ring becomes fully tensioned.

However, this also imparts to the ring 3 its tendency to rise again automatically, by the front edge 3*b* of the trapezoid widened-out portion, owing to its inherent tension. This tension is partly counteracted by the in any case necessary shift of the position of the stays 6 and 7 beyond their dead centre. Yet this alone will in no case afford adequate security against undesired opening, and especially will not do so when, as is unavoidable, the bottle is seized by its top. Therefore, the securing ring 3 must itself be further secured in its tensioned state. For this purpose, it possesses at its opening side the already-mentioned downwardly extending clasp member 8. The ring is firmly held in the securing position by the nose 9 of the clasp member 8 which hooks under the lower edge 1b of the supporting member 1.

When the pressure increases in the bottle eg. when the temperature of the ambient air rises, the sealing collar 18, 28 seals more firmly by being pressed more strongly onto the frontal face 11*a* of the bottle mouth by the increasing pressure in the interior space 19*c*, 26 of the collar. It thereby prevents the closure from unintentionally opening, up to a certain maximum pressure, which latter pressure must, for reasons of safety, lie sufficiently below the bursting stress of the bottle.

Instead of the above-described embodiment of the sealing collar 18 with an elliptical free collar-rim 19, this can be provided with a circular collar-rim 19 and the neighbouring part of the collar wall can be provided with slots dividing it into segments (not shown).

The stopper part 14, in addition to guiding the cap 2 when it is pushed over the bottle mouth, while the wall of the stopper, on the side of the bottle orifice facing the strapjoint 4, glides past the edge of the mouth into the bottle orifice 10, has a further purpose in that it limits the amount of enclosed air in favour of the amount of carbon dioxide, which helps the bottle contents, eg. beer, to keep well.

Figure 11:
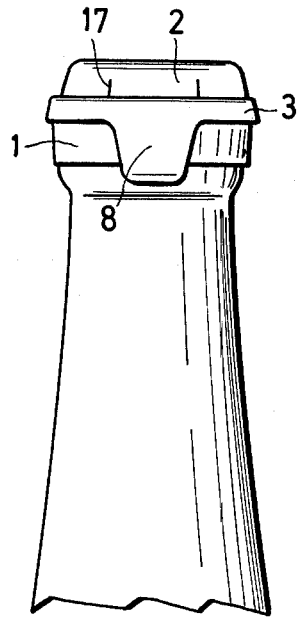
Figure 13:
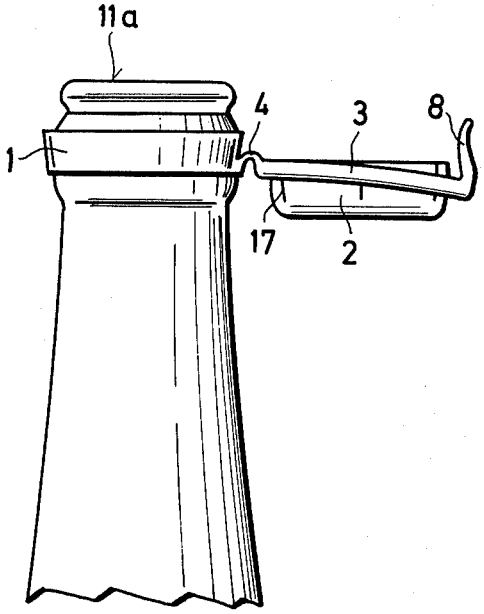
FIG. 13 shows the bottle closure in the open position with the cap-portion turned completely back.

Opening of the bottle closure according to the invention, which is shown in the closing position in FIGS. 6, 10 and 11, is carried out, as shown in FIG. 12, by unhooking the nose 9 of the clasp member 8 and subsequently raising the latter, eg. with the thumb, and thereby lifting up the ring 3 in the end region 3*b* and consequently lifting up the cap 2 by means of the stays 6 and 7, whereby the cap 2 can be bent back into the position shown in FIG. 13.

To ensure that the tongue 8 hooks on more securely, it is useful to give it, in its untensioned state, a position in which it is somewhat more inwardly directed than in the closing position, so as to obtain an adequate bias therein.

The lower end of the clasp member 8, namely the nose 9, is in fact bent outwards; however, because the nose 9 is very thin and thus elastic, it yields easily both inwards and outwards. Consequently, it does not feel uncomfortable when the user grasps the bottle top, but, when the user slides a finger over it from below, it easily bends upwards and curls, and thus handles easily, at first when being unhooked and in a smooth continuation of this movement, so as to lift up the securing ring 3 and further to tip up the cap 2 and open the bottle. The cap always remains connected with the bottle, as it is articulatedly connected with the supporting member 1 through the ring 3 by means of the flexible strap 4.

In this arrangement, the bias of the ring 3 operates favorably insofar as the ring tends to start its opening upwards movement itself after the clasp has been unhooked and thus assists a smooth, continuous opening process.

A few further comments will now be made with regard to the function of individual parts of this embodiment of the bottle closure device according to the invention.

When liquid is poured out of the bottle, the cap 2 of the closure preferably assumes the substantially open position shown in FIG. 1 at an angle of 60° –70° to the frontal face 11a of the bottle mouth, the strap-joint 4 being correspondingly bent back. It can easily be made to stay in this position, eg. by repeated bending back from the angle of about 180°, which is shown in FIG. 13, and in which the closure device is manufactured, eg. by injection molding, from a suitable polymer such as polyethylene, preferably Lupolen 1800 S$^{(R)}$.

A short, thick strap used as strap-joint 4 is thereby more readily given permanent shape than a thin, long strap; moreover, a broad strap offers more resistance than a narrow strap-joint 4 would to the dead weight of the cap 2 and of the ring 3 against undesired shutting in the direction of the position shown in FIG. 4 when the bottle is tilted to pour out liquid therefrom. Finally, the desired position of use can also be influenced by the user, who can swing back the cap 2 more or less hard on opening the bottle, whereby the unbiassing of the strap-joint 4 can again be influenced.

Figure 14:
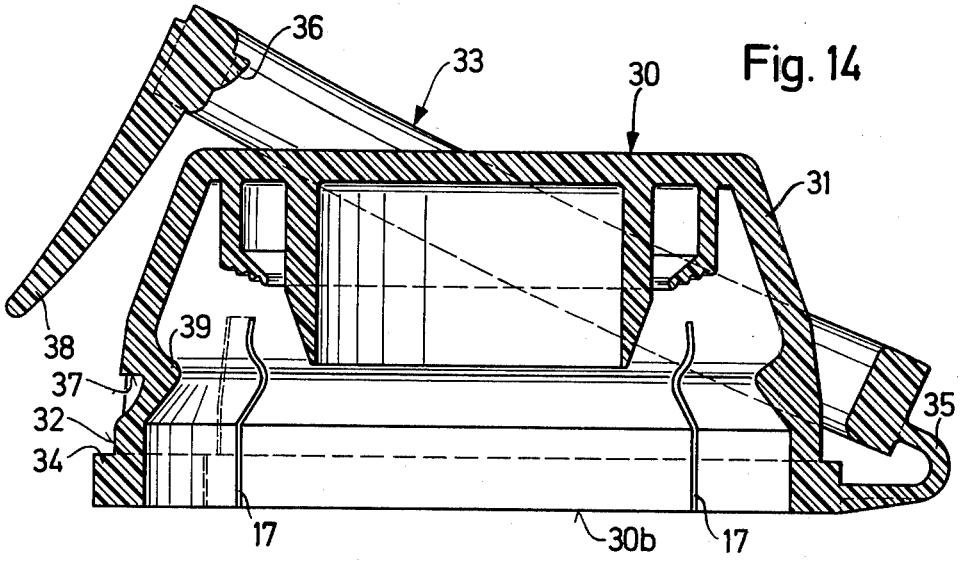
FIG. 14 shows a cross-section through a simplified embodiment of the closure, corresponding to that of FIGS. 1 to 9, but without a supporting member.

In the simplified embodiment of the closure in FIG. 14, corresponding to that of FIGS. 1 to 9, the supporting member has been omitted. The securing ring 33 is connected to the cap 30 near the lower open end of the cap side wall 31 by means of the bridging member 35 acting as a strap-joint, in the same way as in FIGS. 1 to 9.

In place of the stays in the last-mentioned embodiment of the closure, the securing ring 33 carries a single tensioning stay 36 on its inner wall, on the actuating side, which is opposite the side on which the bridging member is located, and an actuating tongue 38 below the stay 36. On the actuating side, the side wall 31 has a recess 37 in its lower outer annular zone 32, which is approximately parallel to the central axis of the cap; on downwardly pressing the securing ring 33, the free end of the tensioning stay 36 engages, in the closing position, in this recess, with the tensioning stay 36 exerting the same action on the cap side wall 31, with narrowing of the slots 17 which have been splayed on mounting the cap, in the outer zone 32 as do the stays 6 and 7 in the embodiment of the closure according to FIGS. 1 to 9. To prevent a further downward-pressing of the securing ring 33, the lower peripheral rim 30b of the cap 30 has an outward-projecting stop bead 34. An inner annular bead 39 is provided on the inner surface of the cap side wall 31 and serves the same function as do the inner annular beads 16 and 49 in the previously described embodiments of the closure of the invention.

A particularly surprising feature of this simple and easily manufactured embodiment is that it withstands a rise in pressure to 6–8 atmospheres gauge in the free space above the bottle contents, which may be, eg., beer or similar carbonated drinks. Higher pressures are attainable by appropriate design of the tensioning device, eg. by using thicker tensioning stays, but this is not permissible because it entails the risk of explosion of the bottle. The closure permits pasteurising of the bottle contents.

The most important advantages of the new closure are, firstly, that substantially less force is required for opening and closing than in the case of the known closure described at the outset, since the opening and closing can easily be effected by lifting the clasp member, or actuating nose, of the ring member or the cap, by means of one finger, as is indicated, eg., in FIG. 12.

The customary and permissible tolerances in dimensions of the bottle neck cannot interfere with the firm seat and reliable functioning of the new closure. The closure is leakproof even if the dimensional tolerances are large, eg. up to 1 mm. The relatively high elasticity and adaptability of shape of the material which may be used for the new closure facilitates compensating such dimensional tolerances. Finally, the closing pressure used can be much less than the permissible maximum internal pressure of the bottle.

To avoid soiling of the outside of the bottle after pouring out of liquid it is possible, in the first-described embodiment of the closure according to the invention, to provide a trough-like or pocket-like recess, which serves as a drip-catcher, in the region of the supporting member opposite to the side carrying the bridging member.

In bottle closures according to the invention manufactured particularly simply by injection molding from a plastic, eg. Lupolen 1800 S of BASF, Ludwigshafen, West Germany, the ring member, the cap and the bridging member which joins the latter to the ring member, and, if present, the supporting member and the strap-joint which joins it to the ring member, may all be molded integrally. In the latter case, where a supporting member is present, injection molding is most simply effected in the position where the cap and the ring member are at an angle of 180° to the supporting member. This also has the advantage that the cap and ring member have a bias urging them into the open position.

The invention thus realises a bottle closure which can be opened and reclosed easily, with one hand, in contrast to the known closure described at the outset, and without tools, in contrast to a crown closure. If a supporting member is present, the closure remains joined to the bottle and can thus automatically be returned with the empty bottle, to a filling station. However the closure does not interfere with drinking from the bottle and can be pulled off the bottle quite simply before the bottle is cleaned in an upside-down position to the modern washing machines used in filling stations.

Where necessary, the bottle closure with supporting member can, shortly before the bottles are washed on the said machines, be pulled upwardly off the bottle by a simple mechanical gripper, eg. with gripper jaws with a knife-edge construction on the insides, whereby the closure is also slit open whilst being pulled upwards. In the preferred simpler embodiments of the closure, the latter is removed before washing the bottles. In that case, after each fill of the bottle, a new closure can be mounted on the bottle neck mechanically, by exertion of simply vertical pressure, the filled bottle being tightly sealed thereby. The closure can in particular be used for standard bottle mouths (SNV-79,100).

Though the closure can very conveniently be opened with one hand, it nevertheless offers good protection against unintended opening. Where the cap has an inward-pointing stopper part, the filled bottle can be closed so as to leave very little air above the contents.

The dispensing orifice is covered by the cap closure, similarly to the situation with a crown cork, and this offers an improvement in hygiene over the old strap closure and the known closure described at the outset.

In contrast to the previously known plastic caps, the seal is not effected against the inner wall of the mouth, the internal diameter of which, being dependent on the amount of material used when blowing the bottles, suffers from particularly wide tolerances, so that a high sealing pressure is required; instead, the seal is effected at the transition zone from the frontal face of the upper, weld-free rim of the mouth to the inner wall of the bottle neck, the outer dimensions of the bottle, up to the mouth, being determined by the mold and tolerances of up to 1 mm being immaterial.

However, whilst with the known closures, the seal must be effected with a high contact pressure, which exceeds the maximum internal pressure of 8 to 10 atmospheres gauge, the sealing element of the closure according to the invention only requires a moderate pressure, sufficient to effect the initial seal, on the stopper sleeve and, where relevant, on the sealing collar. As the internal pressure rises, a good high pressure seal is achieved, according to the invention, if the latter is used, in that the internal pressure on the inside of the collar-shaped sealing element of the closure according to the invention has a similar effect to that in tubeless automobile tires, and presses the sealing collar self-sealingly against the frontal face of the bottle mouth.

The phrase "bottle or the like" means any type of container which has a neck with a preferably central dispensing orifice, the neck wall having the shape described at the outset; it is immaterial whether the container supporting this neck is of circular cross-section, as in the case of, eg., a beer bottle, mineral bottle or wine bottle, or of square cross-section, as is the case, eg., with many liqueur bottles, or is constructed as a "bag in a box" or as any other design which may be desired. Furthermore, this container may be made of glass, ceramic, plastic and even metal. It may be filled with a liquid but can also be filled with a granular solid.

Wherever the terms "top" and "bottom" are used in the preceding description, they relate to the position of the closure according to the invention, especially in the cross-sectional views and the perspective side elevations.

Similar remarks apply to the terms "upwards" and "downwards. "

In order to employ, as far as possible, a consistent nomenclature for the various sides of the cap side wall, the side of the cap side wall opposite to the actuating side has been described as the "opposite side" or "hinge side" 5'.

The term "inwards" denotes a movement in the direction towards the inside of the bottle mouth, that is to say downwards, whilst "upwards" denotes a movement out from the inside of the bottle, that is to say upwards.

The term "slotting" of the cap side wall means that this wall possesses one or more cut-outs or slots which are open at the lower peripheral rim of the cap and extend axially towards the upper wall of the cap. Whilst these slots are broad in the known closure described at the outset, the slots in the closure of the present invention are preferably narrow.

I claim:

1. A closure which serves to close hermetically, but in an easily reopenable manner, a bottle or similar container, which possesses a neck having a dispensing orifice, a neck frontal face surrounding said orifice and an orifice bead located below the latter and having a constricted underside, and which closure comprises a. a cap serving as the head of the closure and having an upper cap wall and a cap side wall circumferential about said upper cap wall and possessing slot means extending from the lower rim of said cap side wall and transversely to said rim, to permit said cap side wall to splay on being mounted on the mouth of the bottle, said cap side wall having an inner annular bead projecting inwards from the inner face of said cap side wall and destined, in the closing position, to engage with the constricted underside of the orifice bead of the bottle, b. a sealing element provided on the inner face of the upper cap wall and serving, in the closing position, to seal the dispensing orifice of the bottle, c. a lifting element which may be actuated by the finger and is located on an actuating side of the cap, and d. fixing means which peripherally bridge each slot present in said cap side wall, at least when in the closing position, by sealingly pressing said inner annular bead of the cap side wall against the constricted underside of the orifice bead of the bottle, said fixing means being linked to the cap side wall in at least one region, remote from the actuating side of the cap side wall, said fixing means comprising tensioning means which, in the closing position, are tensioned by being stretched radially to the cap side wall in a direction toward said actuating side and as a result effects a compression of each slot present in the side wall and provides a uniform pressure, from all sides, of the inner annular cap bead against the underside of the orifice bead of the bottle neck.

2. A closure as described in claim 1, wherein said fixing means comprise a ring member which, before closing, is bent upwards somewhat, on the actuating side, away from its closing position, and on closing is moved downwards, by its region on the actuating side, whereby the slotted cap side wall is compressed and at the same time is sealingly pressed, by its inner annular bead, against the underside of the orifice bead of the bottle, and wherein said tensioning means are provided on the actuating side of the ring member, between the latter and the outer face of the cap side wall, and comprise at least one tensioning member which is tensioned in the closing position, whilst its tension can be released by lifting the ring member, said tensioning member pulling said cap side wall against the orifice bead of the bottle neck on a hinge side opposite the actuating side of said cap, and pressing said cap side wall against the orifice bead of the bottle neck on the actuating side of said cap, as well as tangentially stretching said ring member from the hinge side of said cap towards the actuating side of the latter and, as a result, producing a uniform pressure of the cap side wall against the orifice bead of the bottle neck also in the regions between the hinge side and the actuating side.

3. A closure as described in claim 2, wherein said ring member is in the form of a securing ring which is connected to the cap side wall on the side opposite the actuating side thereof, by means of bridging member.

4. A closure as described in claim 3, wherein said at least one tensioning member is stiff and constitutes a toggle being supported on the securing ring on the one hand, and being supported on the cap side wall, on the other hand, said toggle, in the closing position, tensioning the securing ring by being turned, in the direction of the plane of the peripheral rim of the cap, so as to stretch the toggle.

5. A closure as described in claim 3, wherein said tensioning means comprise, as tensioning members, at least two rigid stays which limit the swivelling movement of the securing ring relative to the cap and which are articulatedly connected, on the actuating side, both to the ring and to the cap.

6. A closure as described in claim 3, wherein said securing ring carries, on the actuating side, a clasp member, serving as a manually movable handle part and possessing a nose pointing inwards to the bottle neck wall, which member engages, in the closing position, in a notch on the lower rim of the closure.

7. A closure as described in claim 3, wherein said cap is provided with several axial slots which permit splaying of the cap side wall when the cap is pushed over the mouth of the bottle neck when the securing ring is swung upwards from the lower cap rim, whilst with the cap in position and the securing ring moved downwards towards the cap and detachably held thereagainst in stretched condition, the said securing ring compresses the slots of the peripheral rim and hence prevents further splaying of the cap side wall if the internal pressure in the bottle should rise.

8. A closure as described in claim 3, wherein said securing ring, the cap and the bridging member which connects the cap to the securing ring are integral with one another.

9. A closure as described in claim 3, wherein said fixing means comprise a part constructed as a supporting member, which can be firmly mounted on the bottle neck below the bottle mouth, on which part the cap is carried, in a manner which permits swivelling, on the side of the bridging member.

10. A closure as described in claim 9, wherein, in order conjointly to carry the securing ring and the cap in a manner which permits swivelling, said supporting member is provided with a strap-joint which is integral with the supporting member and the securing ring.

11. A closure as described in claim 4, wherein said stiff or rigid tensioning member is a tensioning stay projecting from the inner wall of the securing ring on the actuating side, and the cap side wall possesses, on the actuating side and towards its lower peripheral rim, a recess into which the tensioning stay snaps in the closing position, with tangential tension of the lateral regions of the cap side wall.

12. A closure as described in claim 1, wherein said cap possesses, on the inner wall of its upper face, a stopper part which, in the closing position, projects into the mouth of the bottle to act as a guide and seal.

13. A closure as described in claim 12, wherein around the stopper part or the stopper sleeve there is provided, as an additional sealing element, a sealing collar which projects inwards from the upper inner wall of the closure device and which is elastically deformed in the closing position so that it rests sealingly on the frontal face of the bottle mouth.

14. A closure as described in claim 13, wherein said sealing collar is of circular cross-section at its foot, which adjoins the inner wall of the cap, and is of elliptical cross-section at the free rim of the collar when the cap is in the open position, with the major axis of the ellipse extending from the non-actuating side to the opposite side wall of the cap and with the distance of the free rim of the collar from the foot of the collar being constant.

15. A closure as described in claim 13, wherein said sealing collar had a circular cross-section at its foot which adjoins the cap inner wall and at the free rim of the collar, and that axial cut-outs emanating from the free rim of the collar are provided so that the segments which are left between the cut-outs, of the collar wall which adjoins the free rim of the collar, are pushed together in the closing position and sealingly rest against the frontal face of the bottle mouth.

16. A closure as described in claim 13, wherein said sealing collar comprises a stiffened sealing ring and the collar wall which connects the said ring to the foot of the collar has a slightly deflectable foot wall zone adjoining the foot, a more flexible and more elastic bending zone which adjoins the foot wall zone, and a rigid neck zone, carrying the ring, the ring being thickened so that when it rests against the frontal face of the bottle mouth, a free space remains between this frontal face and the collar wall, which space is in communication with the external air through axial slots in the side wall of the cap.

17. A closure as described in claim 13, wherein a free passage at all times remains, between the stopper part and the free rim of the collar, to communicate with the inner space between the collar and the cap inner wall.

* * * * *